US005265966A

United States Patent [19]

Schmidt

[11] Patent Number: 5,265,966

[45] Date of Patent: Nov. 30, 1993

[54] PRINTER LINKAGE

[75] Inventor: Terence J. Schmidt, St. Paul, Minn.

[73] Assignee: Rimage Corporation, Minneapolis, Minn.

[21] Appl. No.: 26,988

[22] Filed: Mar. 5, 1993

[51] Int. Cl.[5] ..... B41J 11/20

[52] U.S. Cl. ..... 400/55; 400/120; 400/613; 400/223; 346/76 PH

[58] Field of Search ..... 400/223, 120, 55, 56, 400/60, 611, 613, 619, 621; 346/76 PH; 156/384

[56] References Cited

U.S. PATENT DOCUMENTS

| | | | |
|---|---|---|---|
| 3,767,098 | 10/1973 | Papodie | 400/621 |
| 4,439,257 | 3/1984 | Sato et al. | 156/384 |
| 4,480,933 | 11/1984 | Shibayama et al. | 400/619 |
| 4,507,666 | 3/1985 | Kondo et al. | 346/76 PH |
| 4,570,870 | 2/1986 | Ito | 242/75.4 |
| 4,692,392 | 9/1987 | Okuno et al. | 346/76 PH |
| 4,877,342 | 10/1989 | Stenudd | 400/124 |
| 4,897,670 | 1/1990 | Hasegawa et al. | 400/55 |
| 5,014,073 | 5/1991 | Sone et al. | 346/76 PH |
| 5,062,722 | 11/1991 | Shiozaki et al. | 400/621 |
| 5,064,300 | 11/1991 | Kashiwaba | 400/56 |
| 5,087,926 | 2/1992 | Wakui | 346/76 PH |
| 5,149,210 | 9/1992 | Eriksson et al. | 400/56 |
| 5,161,905 | 11/1992 | Eriksson et al. | 400/55 |
| 5,172,987 | 12/1992 | Stellmach et al. | 400/56 |
| 5,178,476 | 1/1993 | Lindelow | 400/55 |
| 5,181,787 | 1/1993 | Hosomi | 400/120 |

FOREIGN PATENT DOCUMENTS

| | | | |
|---|---|---|---|
| 0155488 | 8/1985 | Japan | 400/120 |
| 0221558 | 9/1987 | Japan | 400/120 |
| 0251173 | 10/1987 | Japan | 400/120 |
| 0078779 | 4/1988 | Japan | 400/120 |

*Primary Examiner*—Eugene H. Eickholt

*Attorney, Agent, or Firm*—Palmatier, Sjoquist & Helget

[57] ABSTRACT

A linkage system for printers that raises and lowers the print head between the printing of individual labels and that further engages and disengages a ribbon take-up spool. The linkage operates off of the same motor which is utilized to drive the web forward and rearward. A camshaft is coupled to the drive motor through an electrically-operated clutch. A cam follower link engaging the cam is attached to the pivoting connection joint of two cooperating levers. The cooperating levers are pivotally connected between the frame and the pivoting print head. Rearwardly movement of the cam follower link extends the cooperating levers through and just beyond an over-center position locking the cooperating levers and consequently the print head in the raised position. The print head is lowered to the platen when the cam follower link is moved forwardly, unlocking and retracting the levers. Two additional cooperating levers are attached between the print head and the frame with an idler gear at the connecting joint of the two levers, whereby the raising of the print head from the platen disengages the idler gear which drives the ribbon take-up spool. A slip clutch between the idler gear and the ribbon take-up spool limits the ribbon take-up rate.

34 Claims, 4 Drawing Sheets

PRINTER LINKAGE

BACKGROUND OF THE INVENTION

The present invention relates to thermal printers for printing labels conveyed on a web; more particularly, the invention relates to a mechanism for moving a print head into and out of engagement with a platen and for engaging and disengaging a ribbon take-up spool.

The invention is related to the device disclosed in U.S. Pat No. 4,910,675, issued Mar. 20, 1990, which discloses a processing and packaging system for prerecorded computer diskettes including a label printer and applicator, a diverter, a sleever, and a stacker. The present invention relates to a printer of the type to be utilized in printing the labels for diskettes.

Thermal printers of the type of the present invention utilize a row of thermal elements mounted on or as part of a print head. The print head is engaged with the platen with a print medium between the print head and the platen. As the print medium is passed between the print head and the platen particular elements are electrically heated creating an image on the heat-sensitive medium. With the printer of the type associated with the present invention a heat-sensitive ribbon will be positioned between the print head and the web of labels. It is desirable to have the printer capable of printing and applying thirty labels or more per minute.

Typically, in thermal printers, the print head will remain continually engaged with the platen except when the print head is lifted to insert a new web.

In printing a web of adhesive labels where each label is to be applied to diskettes immediately after printing, the web moves forward and rearward and the spaces between the labels present an uneven web thickness. The movement and the uneven web thickness can cause significant wear on the thermal elements if the print head remains engaged with the platen. Additionally, the engagement can interfere or restrict the movement of the web and ribbon affecting the speed of the printer. Additionally, moving the web and label without raising the print head can inadvertently transfer ink to the label. Furthermore, the ribbon used in these types of printers is thin and fragile and could easily be damaged by such motion. Thus, it is efficacious to raise the print head between the printing operation for each label. One means of raising the printer head is through the use of an electric solenoid. Solenoids have significant disadvantages: they generate heat, they consume excessive amounts of electric power; and have nonuniform force through their stroke.

SUMMARY OF THE INVENTION

The present invention provides a linkage system for raising and lowering a print head between the printing of individual labels and further engages and disengages a ribbon take-up spool. The linkage operates off of the same motor which is utilized to drive the web forward and rearward. A camshaft is coupled to the drive motor through an electrically-operated clutch. A cam follower link engaging the cam is attached to the pivoting connection joint of two cooperating levers. The cooperating levers are pivotally connected between the frame and the pivoting print head. Rearwardly movement of the cam follower link extends the cooperating levers through and just beyond an over-center position locking the cooperating levers and consequently the print head in the raised position. The print head is lowered to the platen when the cam follower link is moved forwardly, unlocking and retracting the levers. Two additional cooperating levers are attached between the print head and the frame with an idler gear at the connecting joint of the two levers, whereby the raising of the print head from the platen disengages the idler gear which drives the ribbon take-up spool.

An advantage of the invention is that it utilizes the electric motor that drives the web to also raise and lower the print head between print operations and also to operate the ribbon take-up means. The printer's principal mechanical operations are all driven by the one motor.

An advantage of the invention is that the power requirements of the printer in raising the print head from the platen, in maintaining the print head in the raised position, in maintaining the print head in the lowered position, and in operating the ribbon take-up are minimized. With regard to maintaining the print head in the raised position or lowered position, no external or continuous power is required.

An additional advantage of the invention is that the print head is raised in a parallel time frame with the forward and reverse web motions rather than in a serial time frame facilitating higher operating speeds.

A further advantage of the invention is that the linkage system is suitable for operation at a rate of thirty or more labels per minute.

A further advantage of the invention is that the printer will stay in the same operating position in the event of a power interruption. That is, if the print head is in the raised position when there is a power interruption, it will stay raised.

DETAILED DESCRIPTION OF THE PREFERRED EMBODIMENTS

Figure 1:
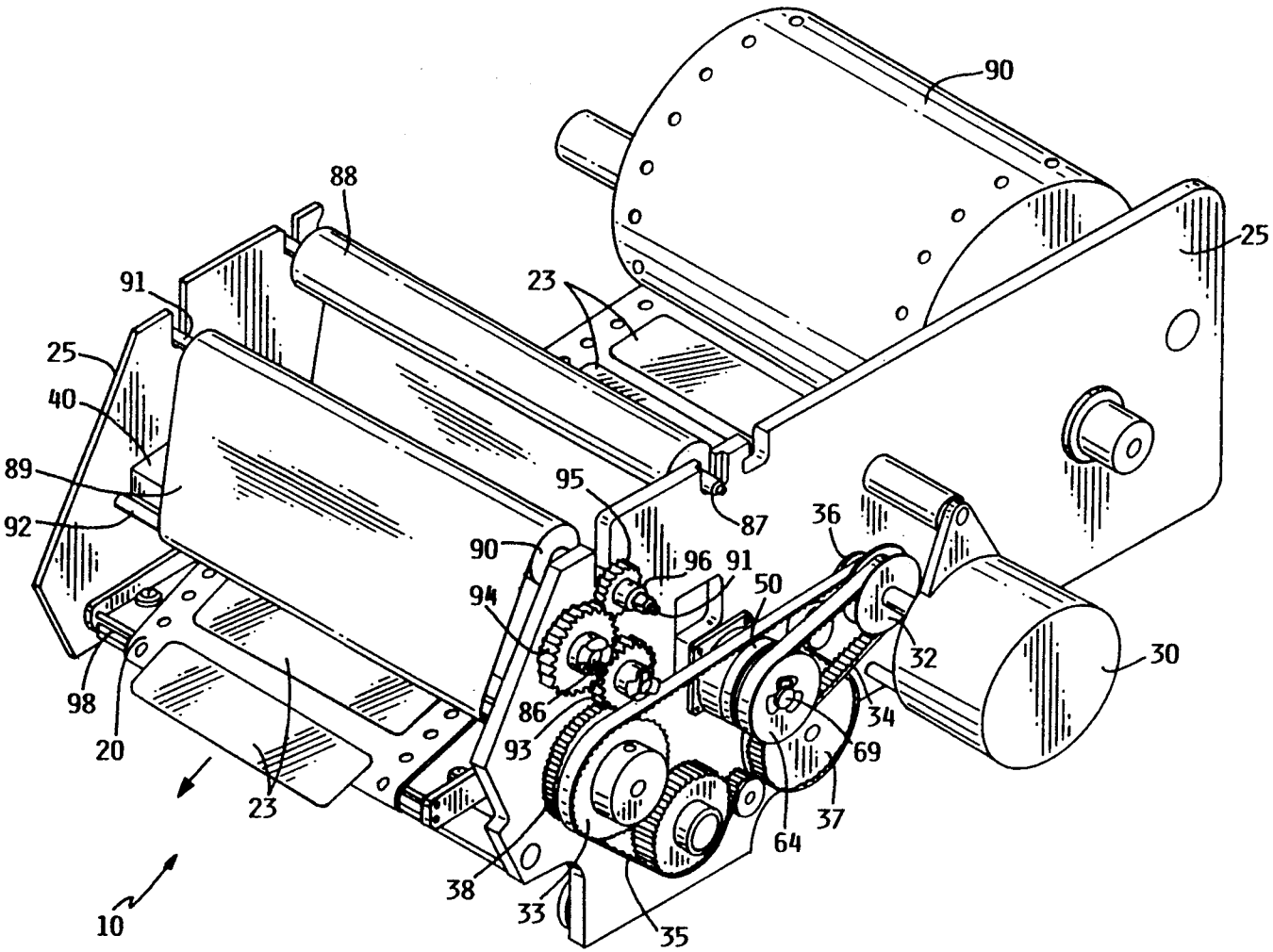
FIG. 1 is a isometric view of the printer with the print head engaged with the platen in the printing position and the ribbon idler gear engaged.

Referring to FIG. 1, a printer 10 is shown in isometric view looking toward the front and the left side of the printer 10. The adhesive labels 23 on the web 20 are dispensed from the front of the printer 10 at the bar 98 where they are separated from the web 20 and are adhered to diskettes being conveyed up from under the printer 10 by external means.

The drive means for the printer 10 is shown mounted on the left side of the printer 10. The motor 30 is mounted on the exterior of the frame 25 with a web drive pulley 36 and a drive pulley 32. A camshaft 62 extends through and is supported by the frame 25. The drive pulley 32 is coupled to a camshaft pulley 64 by way of belt 34. Camshaft pulley 64 is coupled to the camshaft 62 through the electrically-operated clutch 50. The web drive pulley 36 engages the web drive belt 35 which engages tractor drive pulley 37 and pulley 33. Pulley 33 is coupled to gear 38 which meshes with a ribbon driver gear 93. Gear 38 and ribbon driver gear 93 are both rotatably mounted to the frame 25. The ribbon driver gear 93 is coupled to the ribbon take-up gear 95 through the ribbon idler gear 94. Ribbon idler gear 94 is rotatably mounted on an idler gear shaft 86 which extends through an opening 99 in the frame 25. Ribbon stock 88 is wound on the ribbon shaft 87 and the ribbon 89 is fed underneath the print head 40 and above the web 20 to a ribbon bar 92 which directs the ribbon 89 up to the ribbon take-up spool 90. The ribbon take-up spool 90 is fixed to the ribbon take-up shaft 91 which is resistably coupled by way of a friction fitting 96 to the ribbon take-up gear 95. The take-up shaft 91 is supported by and rotatably mounted within the frame 25.

Figure 2:
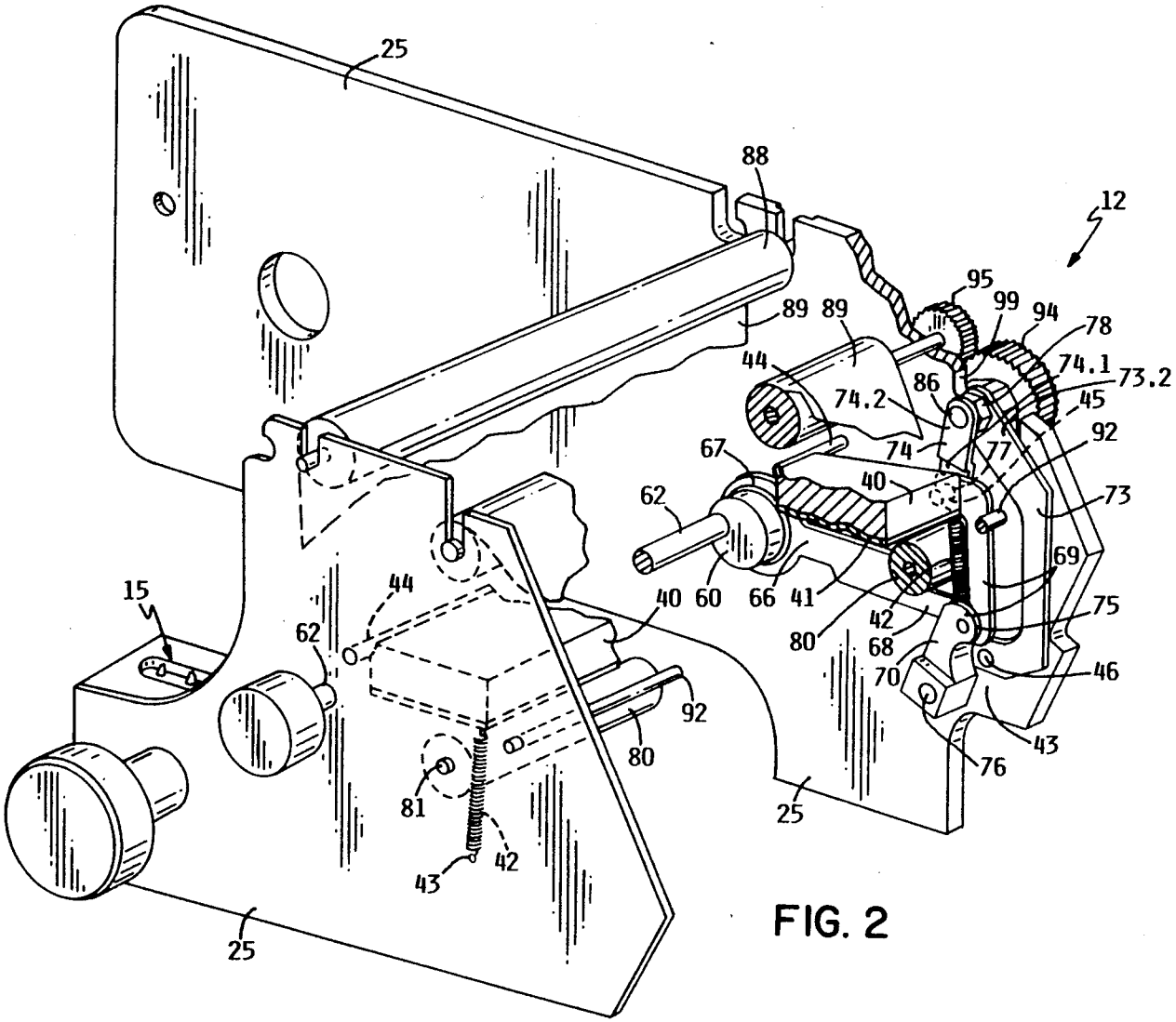
FIG. 2 is an isometric view of the printer with the print head lowered in a printing position and with appropriate parts removed and cut away to expose the printer linkage.
Figure 3:
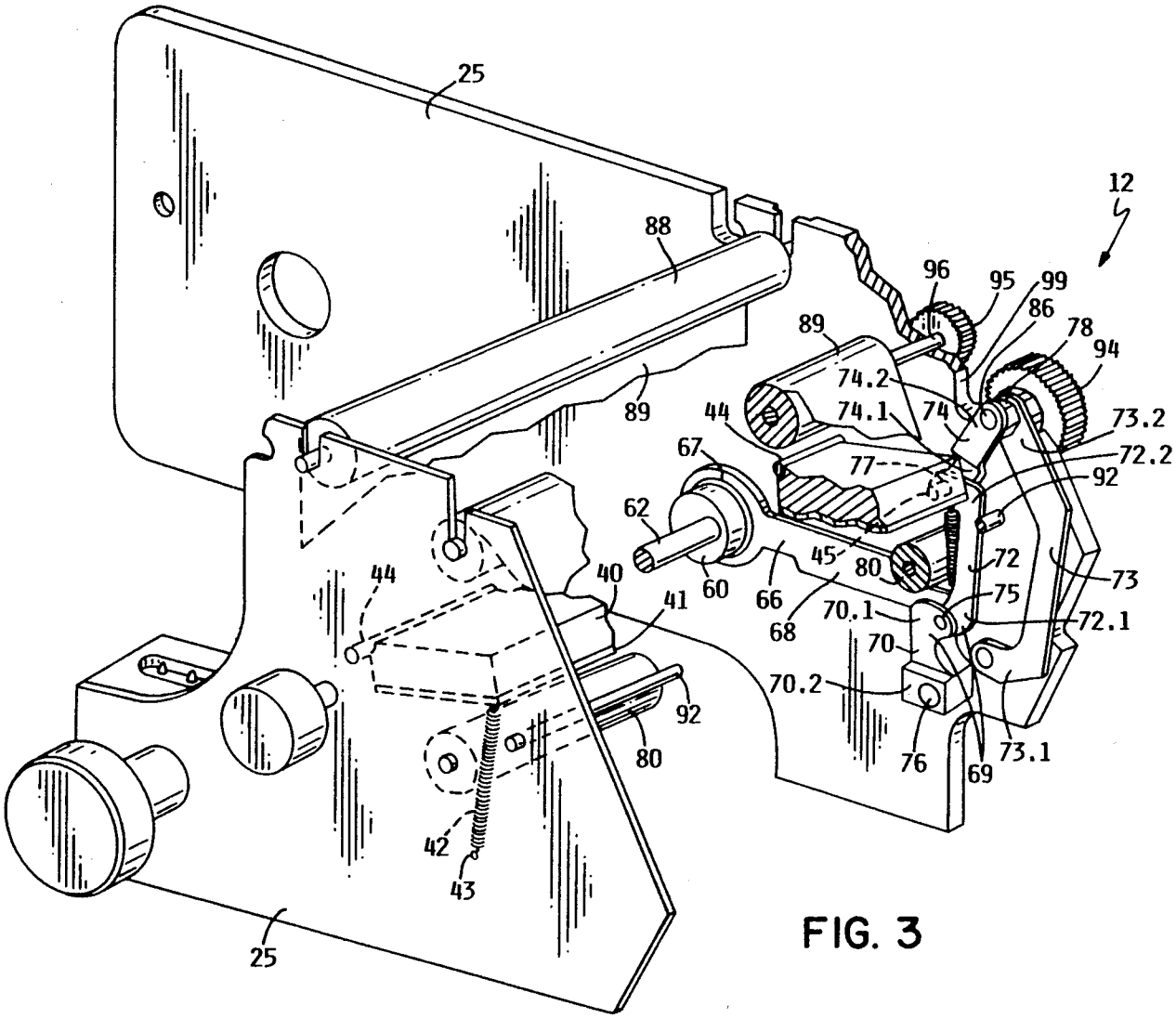
FIG. 3 shows the same view as FIG. 2 except with the print head raised.

FIGS. 2 and 3 show a view of the printer 10 directed toward the front and right side with appropriate parts removed and cut away to expose the invention, the printer linkage 12. FIG. 2 shows the print head 40 in a printing position or a lowered position against the platen roller 80. FIG. 3 shows the print head 40 in a raised position. The cam 60 is fixed to the camshaft 62 and is shown in two positions in FIG. 2 and FIG. 3. The cam follower link 66 encircles the cam 60 and rides on a cam bearing 67. The distal end 68 of the cam follower link 66 connects to the cooperating levers 69 consisting of the middle lever 72 and the lower lever 70. The cam follower link 66, the first end 70.1 of the lower lever 70, and the first end 72.1 of the middle lever 72 are all pivotally joined at the first joint 75 which is not secured to the frame 25. The second end 70.2 of the lower lever 70 is pivotally mounted to the frame 25 at the second joint 76. The second end 72.2 of the middle lever 72 is pivotally mounted on the print head 40 at a third joint 77 by a pin 45.

The print head 40 is mounted by way of a print head shaft 44 which is mounted to both sides of the frame 25 so that the print head 40 may pivot toward and away from the platen roller 80 which is directly below the print head 40. For purposes of clarity the web 20 and ribbon 89 are not in place between the print head 40 and the platen roller 80 in FIGS. 2 and 3. The thermal print element 41 is part of the print head 40. Platen roller 80 is on a shaft 81 that extends through both sides of the frame 25. Two springs 42 are used to provide downward bias of the print head 40 to engage the platen roller 80 with the appropriate print head to platen pressure for printing. The springs 42 are anchored on the frame 25 by way of spring anchors 43.

The first end 74.1 of an upper lever 74 is also pivotally mounted on the pin 45 attached to the print head 40. The second end 74.2 of the upper lever 74 is pivotally connected to the second end 73.2 of the elongate lever 73 at the fourth joint 78. The idler gear shaft 86 also is connected to the fourth joint 78. The first end 73.1 of the elongate lever 73 is pivotally mounted on a pin 46 which is attached to the frame 25.

Figure 4:
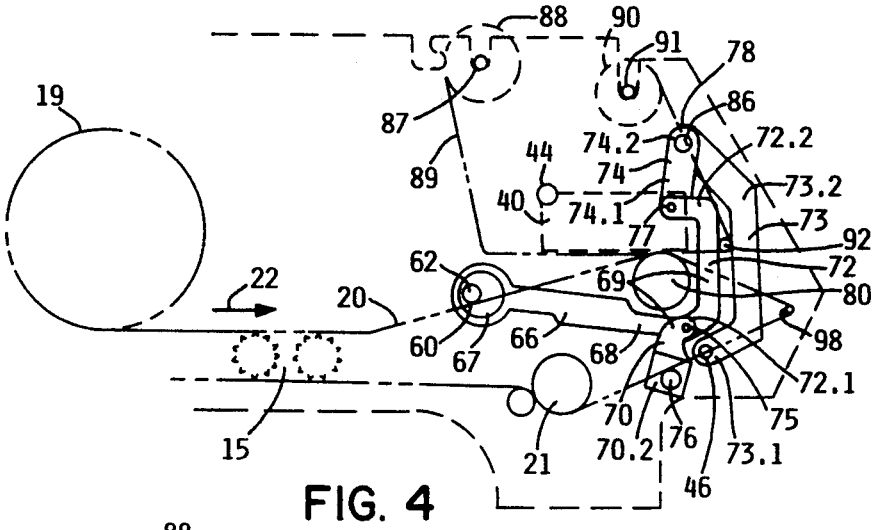
FIG. 4 shows a diagrammatic elevation of the invention with the print head lowered.
Figure 5:
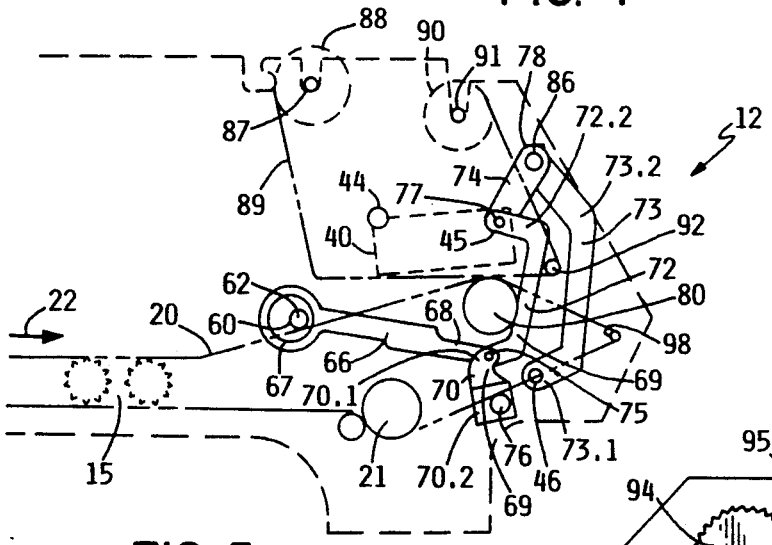
FIG. 5 shows a diagrammatic elevation of the invention with the print head raised.

FIGS. 4 and 5 show diagrammatic elevation views looking toward the linkage 12 from the right side of the printer 10. FIG. 4 shows the print head 40 in a lowered or printing position and FIG. 5 shows the print head 40 raised from the platen roller 80. The ribbon path is shown originating at the ribbon stock 88 down to the ribbon guide 47 between the print head 40 and platen roller 80 to the ribbon bar 92 and up to the ribbon take-up spool 90. The web path originates at the web stock 19, goes to the tractor drive 15, then upwardly to platen roller 80, passes between the print head 40 and the platen roller 80 underneath the ribbon 89, then goes to the web bar 98, down to web roller 21, back to the tractor drive 15, and then exits the printer 10.

Figure 6:
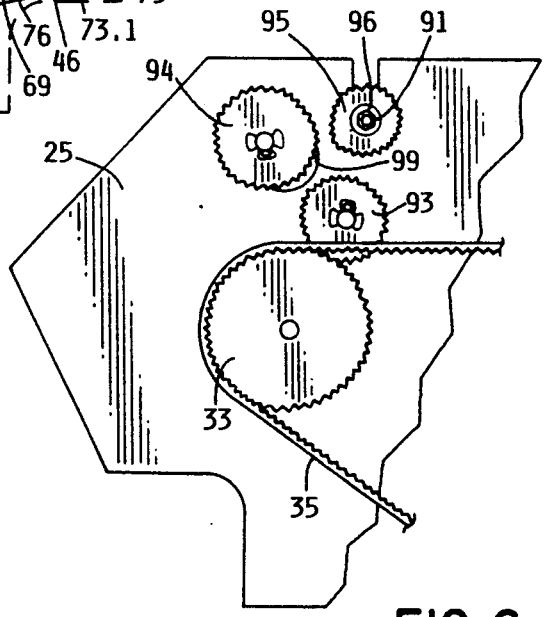
FIG. 6 shows an elevation of a portion of the left side of the printer with the ribbon idler gear disengaged.

Referring to FIG. 6, a portion of the left side of the printer 10 is depicted with the ribbon idler gear 94 shown disengaged from the ribbon take-up gear 95 and the ribbon driver gear 93. The disengagement of the ribbon idler gear 94 corresponds to the raised position of the print head 40 shown in FIGS. 3 and 5.

The apparatus operates as follows. With the print head 40 in the lowered or operating position as shown in FIGS. 1, 2, and 4, the print head 40 is pressed against the ribbon 89 and web 20 which is supported by the platen roller 80. Referring to FIGS. 4 and 5, the web 20 moves in a forward direction as indicated by arrow 22 toward the front of the printer 10 during the print operation. The web 20 is moved forward by way of the web roller 21 and the platen roller 80. When the print head 40 is lowered, the engagement of the ribbon 40 and the web 20 between the print head 40 and the platen roller 80 advances the ribbon 40 with the web 20 at the same advancement rate.

Referring to FIG. 1, the web roller 21 and platen roller 80 are coupled to the web drive belt 35 by way of pulley 33 and pulley 39. The web drive belt 35 is incrementally driven forward and rearward by the electric motor 30. During the print operation on a specific label, the print head 40 is in the lowered printing position and the web 20 and ribbon 89 are advanced forwardly between the print head 40 and platen roller 80 as the thermal elements 41 in the print head 40 are activated to impart the image on the specific label. When the print head 40 is in the printing position, a print head to platen pressure is provided for proper imaging on the labels. This pressure is provided by the springs 42.

When the printing operation on a specific label has been completed, the web 20 continues to move forward and the electric clutch 50 is engaged. Referring to FIGS. 4 and 5, the cam follower link 66 is in a forward position when the print head 40 is engaged with the platen 80. Activation of the clutch 50 rotates the cam 60 and pulls the cam follower link 66 rearwardly causing an extension of the cooperating levers 69 which consist of the lower lever 70 and the middle lever 72. The extension of the cooperating levers 69 causes the print head 40 to pivot away from the platen roller 80 about the print head shaft 44. The clutch 50 is engaged until the cooperating levers 69 have moved past their maximum extension, or "over-center" position at which point the clutch 50 is disengaged. FIG. 5 shows the first joint 75 just past the centered position between the second joint 76 and the third joint 77. In this position the cam follower link 66 cannot move further in a rearward direction. The springs 42 provide bias to retain the cooperating levers 69 in the "over-center" position. The cooperating levers 69 must be extended by the cam follower link 66 moving forward before the print head 40 can be lowered. The print head 40 is thus effectively locked in the raised position. The web 20 continues to be driven forward until the label 23 reaches the bar 98 at which point it is separated from the web 20 and is attached to a diskette passing under the web 20. The web drive direction is then reversed by reversal of the motor 30 to position the next label under the print head 40. As the web 20 is driven rearwardly, before the next label is in position, the electric clutch 50 is activated to move the cam follower link 66 in a forward direction. This moves the cooperating levers 69 out of their locked position through their over-center position, retracts the cooperating levers 69 and lowers the print head 40 to platen roller 80 just as the next label 23 is moving into position under the print head 40. The clutch 50 is then disengaged.

When the print head 40 is in the lowered position and the web 20 and ribbon 89 are being advanced forward, the ribbon idler gear 94 is engaged between the ribbon take-up gear 95 and the ribbon driver gear 93. The ribbon driver gear 93 is coupled to the web drive belt 35 by way of the platen roller gear 82. The ribbon take-up gear 95, the ribbon idler gear 94, the ribbon driver gear 93, and the ribbon take-up spool 90 are sized so that the take-up rate of the ribbon take-up spool 90 is never less than the advancement rate of the web 20 and ribbon 89. For a given rotational rate the take-up rate varies with the diameter of the ribbon wound on the spool. The take-up rate is at a minimum with nominal ribbon wound on the spool 90 and increases as more ribbon is wound and the diameter increases. The ribbon take-up gear 95 is coupled to the ribbon take-up shaft 91 and ribbon take-up spool 90 through a slip clutch 96. The slip clutch 96 allows slippage between the ribbon take-up gear 95 and the shaft 91 as the diameter of the ribbon 89 wound on the take-up spool 90 increases. The slip clutch is sized so that sufficient torque is transmitted through the slip clutch 96 to take up any slack in the ribbon 89 and to keep the ribbon 89 taut but not enough torque to stretch or tear or pull the ribbon 89 faster than it is advanced.

The engagement of the ribbon idler gear 94 between the ribbon driver gear 93 and the ribbon take-up gear 95 is dependent upon the position of the print head 40. The ribbon idler gear 94 is rotatably mounted on the idler gear shaft 86 which extends through the frame at opening 99. When the print head 40 is raised, the upper lever 74 connected to the print head 40, cooperating with elongated lever 73, causes the idler gear shaft 86 and idler gear 94 to rotate slightly about pin 46 in a direction away from the ribbon driver gear 93 and the ribbon take-up gear 95 causing a disengagement of the idler gear 94. The lowering of the print head 40 causes the idler gear 94 to rotate back toward and to engage the driver gear 93 and the ribbon take-up gear 95.

Notably, the ribbon take-up gear 95 is engaged with the ribbon driver gear 93 and the ribbon take-up gear 95 only when the print head 40 is engaged with the platen roller 80. Additionally, the ribbon take-up gear 95 is driven only when the web is moved forward during the printing operation.

An alternative embodiment of the invention, not shown, has the cooperating levers 69, cam shaft 62, and cam follower link 66 arranged so that the forwardly movement of the cam follower link 66 operates to extend the cooperating levers 69 to raise the print head 40 from the platen roller 80, and rearwardly movement of the cam follower link 66 lowers the print head 40 to the platen roller 80.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. Printer linkage for printers that perform printing operations on a continuous web, the printer comprising a frame, a web driving means, a print head, a platen, the print head confronting and movable toward the platen to a printing position and away from the platen, the web positioned between the print head and the platen, the linkage comprising:

a) a camshaft rotatably mounted to the frame, a cam fixed to the camshaft, a cam follower link engaged with the cam and having a distal end whereby rotation of the camshaft moves the cam follower link forwardly and rearwardly;

b) a camshaft drive means; and c) a pair of cooperating levers, comprising a middle lever and a lower lever, each with a first end pivotally connected to the distal end of the cam follower link defining a first joint, the lower lever having a second end pivotally connected to the frame defining a second joint, and the middle lever having a second end pivotally attached to the print head defining a third joint, the second and third joints defining a distance between them, the cooperating levers and cam follower link positioned so that the forwardly and rearwardly motion of the cam follower link operates to vary the distance between the second and third joints thereby moving the print head toward or away from the platen.

2. The apparatus of claim 1, further comprising a bias means for urging the print head toward the platen.

3. The apparatus of claim 2, wherein the cam follower link is in a forwardly position when the print head is in the printing position and rearwardly movement of the cam follower link from the forward position increases the distance between the second and third joint and moves the print head away from the printing position.

4. The apparatus of claim 3, wherein the cam follower link has a maximum rearward position and a maximum forward position and the distance between the second joint and third joint has a maximum separation distance, wherein the lower lever, the middle lever, the camshaft, the cam, and the cam follower link are sized and positioned so that as the cam follower link moves rearwardly, moving the print head away from the platen, the maximum separation distance is obtained before the maximum rearward position of the cam follower link, whereby the bias means holds the cooperating levers in a locked position with the cam follower link at the maximum rearward position necessitating a forwardly movement of the cam follower link to unlock the cooperating levers and to move the print head to the platen.

5. The apparatus of claim 2, wherein the cam follower link is rearwardly positioned when the print head is in the printing position and a forwardly movement of the cam follower link from the rearward position by rotation of the camshaft increases the distance between the second and third joint moving the print head away from the platen.

6. The apparatus of claim 5, wherein the cam follower link has a maximum forward position and the distance between the second joint and third joint has a maximum separation distance, wherein the lower lever, the middle lever, the camshaft, the cam, and the cam follower link are sized and positioned so that as the cam follower link moves forwardly, moving the print head away from the printing position, the maximum separation distance is obtained before the maximum forward position of the cam follower link, whereby the bias means holds the cooperating levers in a locked position with the cam follower link at the maximum forward position necessitating a rearwardly movement of the cam follower link to unlock the cooperating levers and to move the print head to the platen.

7. The apparatus of claim 1, wherein the print head is pivotally mounted on the frame whereby the print head pivots as it is moved toward or away from the platen member.

8. The apparatus of claim 1, wherein the forwardly and rearwardly movement of the distal end of the cam follower link is substantially intermediate the second and third joints.

9. The apparatus of claim 2, wherein the bias means is comprised of an extension spring with one end attached to the print head and a second end attached to the frame.

10. The apparatus of claim 1, wherein the platen is comprised of a roller which rotates as the web is moved between the platen and print head.

11. The apparatus of claim 1, wherein the web drive means is comprised of an electric motor.

12. The apparatus of claim 11, wherein the camshaft drive means is comprised of an electric motor and an electrically-operated clutch mechanically connected between the electric motor and the camshaft.

13. The apparatus of claim 1, wherein the printer further utilizes a continuous ribbon fed between the web and the print head and the ribbon is advanced with the web during the printing operation at a web advancement rate.

14. The apparatus claim 13, further comprising a ribbon take-up means.

15. The apparatus of claim 14, wherein the ribbon take-up means comprises:

a) a driven gear mechanically coupled to the electric motor;

b) a ribbon take-up spool rotatably mounted on the frame, a take-up spool gear, and a means for coupling the take-up spool gear and the take-up spool;

c) an idler gear removably engageable between the driven gear and the take-up spool gear; and d) an engagement means for engaging the idler gear between the driven gear and take-up spool gear.

16. The apparatus of claim 15, wherein the engagement means comprises an elongate lever with a first end pivotally connected to the frame and a second end pivotally attached to the idler gear, an upper lever with a first end pivotally attached to the idler gear and a second end pivotally connected to the print head, the levers so positioned that as the print head moves away from the printing position the idler gear is disengaged, and as the print head moves into the printing position the idler gear is engaged.

17. The apparatus of claim 16, wherein the means for coupling the take-up gear to the take-up spool comprises a slip clutch, wherein rotation of the take-up spool provides a ribbon take-up rate, and wherein the idler gear, the ribbon driver gear, the take-up gear, and the take-up spool are sized so that the ribbon take-up rate never is less than the web advancement rate and wherein the slip clutch is sized so that it restricts the ribbon take-up rate to the web advancement rate.

18. The apparatus of claim 1, wherein the web comprises a plurality of spaced-apart labels adhesively affixed to said web and positioned at regular intervals on said web.

19. The apparatus of claim 4, wherein the print head engages with the platen in the printing position before the maximum forward position of the cam follower link is obtained preventing any additional forward movement of the cam follower link.

20. The apparatus of claim 19, wherein when the print head is in a printing position a print head to platen pressure is provided for the printing operations and wherein the bias means provides substantially all of the print head to platen pressure.

21. An apparatus for moving a print head toward a platen to engage the platen through a web, and away from the platen to disengage the platen, the apparatus comprising:

a) a frame;

b) a print head pivotally mounted on the frame whereby the print head engages and disengages the platen through the web;

c) a camshaft rotatably mounted to the frame, a cam fixed to the camshaft, a cam follower link engaged with the cam and having a distal end whereby rotation of the camshaft moves the cam follower link forwardly and rearwardly;

d) a camshaft drive means;

e) a pair of cooperating levers, comprising a middle lever and a lower lever, each with a first end pivotally connected to the distal end of the cam follower link defining a first joint, the lower lever having a second end pivotally connected to the frame defining a second joint, and the middle lever having a second end pivotally attached to the print head defining a third joint, whereby a forwardly movement of the cam follower link substantially extends the cooperating levers and a rearwardly movement of the cam follower link substantially retracts the cooperating levers disengaging and engaging the print head with the platen; and f) a bias means for urging the print head toward the platen.

22. The apparatus of claim 21, wherein the forward movement of the cam follower link extends the cooperating levers past an over-center position to a locked position whereby a rearward movement of the cam follower link unlocks the cooperating levers.

23. The apparatus of claim 22, wherein the bias means is comprised of a spring with one end attached to the print head and a second end attached to the frame.

24. The apparatus of claim 23, wherein the platen is comprised of a roller which rotates as the web is moved between the platen and print head.

25. The apparatus of claim 24, wherein the web drive means is comprised of an electric motor.

26. The apparatus of claim 25, wherein the camshaft drive means is comprised of the electric motor and an electrically-operated clutch mechanically connected between the electric motor and the camshaft.

27. The apparatus of claim 26, wherein the printer further utilizes a continuous ribbon fed between the web and the print head and the ribbon is advanced with the web during the printing operation at a web advancement rate.

28. The apparatus of claim 27, further comprising a ribbon take-up means.

29. The apparatus of claim 28, wherein the ribbon take-up means comprises:

a) a driven gear mechanically coupled to the electric motor;

b) a ribbon take-up spool rotatably mounted on the frame, a take-up spool gear, and a means for coupling the take-up spool gear and the take-up spool;

c) an idler gear removably engageable between the driven gear and the take-up spool gear; and d) an engagement means for engaging and disengaging the idler gear between the driven gear and take-up spool gear.

30. The apparatus of claim 29, wherein the engagement means comprises an elongate lever with a first end pivotally connected to the frame and a second end pivotally attached to the idler gear, an upper lever with one end pivotally attached to the idler gear and the other end pivotally connected to the print head at the second joint, the levers so positioned that as the print head moves away from the printing position the idler gear is disengaged from the driven gear and the take-up spool gear, and as the print head moves into the printing position the idler gear is engaged between the driven gear and the take-up spool gear.

31. The apparatus of claim 30, wherein the means for coupling the take-up gear to the take-up spool comprises a slip clutch, wherein rotation of the take-up spool provides a ribbon take-up rate, and wherein the idler gear, the ribbon driver gear, the take-up gear, and the take-up spool are sized so that the ribbon take-up rate never is less than the web advancement rate and wherein the slip clutch is sized so that it restricts the ribbon take-up rate to the web advancement rate.

32. The apparatus of claim 31, wherein the web comprises a plurality of spaced-apart labels adhesively affixed to said web and positioned at regular intervals on said web.

33. The apparatus of claim 32, wherein the print head engages with the platen in the printing position before the maximum rearward position of the cam follower link is obtained preventing any additional rearward movement of the cam follower link.

34. The apparatus of claim 33, wherein when the print head is in a printing position a print head to platen pressure is provided for the printing operations and wherein the bias means provides substantially all of the print head to platen pressure.

* * * * *